US008287231B2

(12) United States Patent
Burgess

(10) Patent No.: US 8,287,231 B2
(45) Date of Patent: Oct. 16, 2012

(54) PRESSURE RELIEF ARRANGEMENT FOR A PUMP

(75) Inventor: Kevin Edward Burgess, Carlingford (AU)

(73) Assignee: Weir Minerals Australia Ltd. (AU)

( * ) Notice: Subject to any disclaimer, the term of this patent is extended or adjusted under 35 U.S.C. 154(b) by 1087 days.

(21) Appl. No.: 12/229,703

(22) Filed: Aug. 25, 2008

(65) Prior Publication Data

US 2009/0067980 A1 Mar. 12, 2009

Related U.S. Application Data

(63) Continuation of application No. 10/557,459, filed as application No. PCT/AU2004/000646 on May 17, 2004, now Pat. No. 7,416,380.

(30) Foreign Application Priority Data

May 23, 2003 (AU) ..... 2003902582

(51) Int. Cl.
*F01D 21/00* (2006.01)

(52) U.S. Cl. ..... 415/9

(58) Field of Classification Search ..... 415/9, 126, 415/128, 206; 417/283, 900
See application file for complete search history.

(56) References Cited

U.S. PATENT DOCUMENTS

| | | | | |
|---|---|---|---|---|
| 1,324,036 | A * | 12/1919 | Laval | 411/532 |
| 1,495,946 | A * | 5/1924 | Bassett | 285/2 |
| 3,599,528 | A * | 8/1971 | Kushnick | 411/337 |
| 3,711,218 | A | 1/1973 | Kennel et al. | |
| 4,479,587 | A * | 10/1984 | Mundt et al. | 220/89.2 |
| 5,129,659 | A | 7/1992 | Ootsuka et al. | |
| 5,209,635 | A | 5/1993 | Stewart et al. | |
| 5,219,274 | A * | 6/1993 | Pawlowski et al. | 417/213 |
| 5,472,318 | A | 12/1995 | Frank et al. | |

FOREIGN PATENT DOCUMENTS

| | | |
|---|---|---|
| CA | 1 220 399 | 4/1987 |
| DE | 41 16 697 C1 | 3/1992 |
| DE | 91 11 157 U1 | 1/1993 |
| FR | 2 290 133 A | 5/1976 |
| GB | 191026913 A | 0/1911 |
| GB | 2 203 491 A | 10/1988 |
| WO | WO 02/101245 A | 12/2002 |

* cited by examiner

*Primary Examiner* — Edward Look
*Assistant Examiner* — Aaron R Eastman
(74) *Attorney, Agent, or Firm* — Morriss O'Bryant Compagni

(57) ABSTRACT

A pressure relief arrangement for a pump, which includes a pump housing assembly with a pumping chamber therein, is provided in the pump housing assembly of the pump and includes a section mounted for movement between a normal operating position and a venting position, further includes a shearing element adapted to retain the section in the normal operating position, the section being mounted such that upon pressure within the pumping chamber increasing to a specified level, the pressure acts on the section and the shearing element will fail thereby permitting movement of the section from the normal operating to the venting position.

8 Claims, 5 Drawing Sheets

PRESSURE RELIEF ARRANGEMENT FOR A PUMP

CROSS-REFERENCE TO RELATED APPLICATION

This application is a continuation of U.S. Ser. No. 10/557,459, filed under 35 U.S.C. §317 on Nov. 18, 2005 now U.S. Pat. No. 7,416,380 and based on International Application No. PCT/AU2004/000646 having an international filing date of May 17, 2004, from which priority is claimed.

BACKGROUND OF THE INVENTION

1. Field of the Invention

The present invention relates generally to pumps and more particularly, to a pressure relief arrangement for pumps.

2. Description of Related Art

Normal water pumps do not handle solids but it has been noted that when the flowrate is say, equal to or less than 10% than that of the maximum flowrate at any particular pump speed, the temperature of the liquid recirculating inside the pump will increase with time. The heat generated causes the pump casing and components to also increase in temperature. It is therefore quite common for manufacturers to recommend a minimum flowrate for a pump to avoid this problem area. Measurement and control of flowrate and therefore temperature for water pumps are relatively easy and there is a multitude of suitable equipment available. Some schemes involve a separate bypass to maintain flow through the pump.

Centrifugal Slurry Pumps are typically applied in a very wide range of industries and applications worldwide and most commonly in mining plants. The mixture of liquids (commonly water) and solids that make up the slurry that these slurry pumps handle are also very wide ranging. Similar to water pumps, slurry pumps will heat up if operated at low flowrates for any significant time. Low flow rates can be caused inadvertently by blockages occurring in the pump due to the slurry being pumped. The heat generated can also be detrimental to the wear resistant hard metal or natural rubber liners commonly used in slurry pumps. In a worst case scenario, it is possible that the steam generated from such overheating due to pump blockage conditions may cause the pump to explode.

Slurry pumps are normally installed in quite similar types of arrangements, with a hopper to gravity-feed the slurry into the pump, followed by different length pipelines, generally with bends, sloping or horizontal sections of pipework. In some cases valves or tanks are located along the pipeline to the final discharge point.

For measuring slurry flowrate or slurry fluid temperature, there are relatively few options available since slurry can easily clog or jam instruments and/or cause wear. Consequently, it is common practice to utilize very few instruments in the pumping of slurry and to rely on the continuous flow of slurry from one process to another. Slurry pump manufacturers and suppliers can provide a minimum flowrate for a slurry pump, but with the wide range of possible duties, change in slurry properties and the possibility of solids settling in the pipeline or pump, such minimum flowrate recommendations will not, by themselves, guarantee that the flowrate will not change or drop in service to critically low levels.

Transport of the slurry particles relies on maintaining a certain velocity in the pipeline; otherwise particles tend to settle out on the bottom of the pipe. As the velocity drops further, the solids will build-up in the pipeline and eventually may cause a blockage. A similar scenario can occur in a slurry pump operating at very low or zero flowrate. The solids start to settle out in the pump and can cause a blockage. Even if the pump is running, the pump can eventually become completely choked with solids.

All horizontal slurry pumps have a pump casing with an impeller rotating inside the casing. The impeller is attached to one end of a cantilevered shaft. The shaft rotates in bearings and enters the drive side of the pump casing through a seal chamber that houses a seal device of some form. The seal chamber is normally a separate component that is positioned at the back of the pump casing and takes a number of forms. One form is a stuffing box, which contains packing rings that provide a seal device for sealing the shaft as it passes through the seal chamber/pump casing wall. Another form is an expelling chamber. One or both of these two forms can be utilized regardless of the pump duty, liner material or application. Another type of seal device is a mechanical seal. In all cases, the seal device is contained in the seal chamber, which is supported by the pump casing.

The seal chamber at the drive side of the pump is supported by the pump casing and is generally sealed at its periphery against the internal pump liner, which could be metal or elastomer material. The internal pressure inside the pump casing acts on the inside surface of the seal chamber. The seal chamber is sealed against the main pump liner with a seal such as an O-ring seal or other type of elastomer seal.

BRIEF SUMMARY OF THE INVENTION

In accordance with the present invention, a pressure relief arrangement for use in rotodynamic pumps, particularly of the slurry type, is provided for allowing pressure built up within the pump casing to be safely dissipated. The pressure relief arrangement may be installed in a variety of rotodynamic pumps, and may be retrofit into an existing pump. Methods of installation are disclosed herein for that purpose.

According to one aspect of the present invention there is provided a pressure relief arrangement for a pump which includes a pump housing assembly with a pumping chamber therein, the pump housing assembly including a section mounted for movement between a normal operating position and a venting position, a shearing element being adapted to retain the section in the normal operating position, the section being mounted so that pressure within the pumping chamber can act on the side section, the arrangement being such that upon the pressure within the pumping chamber reaching a specified pressure, the shearing element will fail thereby permitting movement of the side wall section from the normal operating to the venting position. In the venting position the pressure within the pumping chamber can be relieved.

In one form of the invention, the pump includes a pumping chamber and a sealing chamber in fluid communication therewith. The sealing chamber includes a side wall section mounted for movement between an operative position and a venting position, the shearing element being adapted to retain the side wall section in the operative position. The arrangement is such that, upon the pressure within the sealing chamber reaching a specified pressure, the shearing element will fail thereby permitting movement of the side wall section from the operative position to the venting position.

The pump may include a casing having two parts operatively connected together with the pumping chamber therein. The pump may include an inlet and outlet as is conventional. An impeller may be provided within the pumping chamber and is adapted to be driven by a drive shaft.

The sealing chamber may form part of a sealing assembly, the side wall section being mounted for limited axial movement. Preferably, the side wall section of the seal chamber is mounted in an installed position relative to one of the parts of the pump casing or housing. The pump casing and the side wall section may have cooperating shoulders thereon and the shearing element may be adapted to be disposed therebetween.

In one form, the shearing element may include a ring shaped body having one or more shearing flanges projecting generally radially therefrom. In the installed position, one side edge of the ring is adapted to abut against one of the shoulders and the shearing flange is adapted to abut against another of the shoulders. The shoulders of the parts are spaced apart so that on failure of the shearing element, axial movement between the two parts is permitted.

In another form of the shearing ring, the or each shearing flange is replaced with a protruding shear pin which is adapted to fit into a hole in the ring shaped body. In this embodiment the load is taken by each pin which fails in shear at a particular pressure.

There may further be provided means for inhibiting rotation of the side wall. In one form, such means may include one or more lugs which are adapted to abut against a part of the pump casing.

According to another aspect of the present invention there is provided a shearing element for use in the arrangement described above, the shearing element including a body portion and shearing lug or projection which is adapted to fail at a specified overpressure within the pump chamber. Preferably, the shearing element includes a ring shaped body with one or more lugs or pins extending radially therefrom. Preferably, two lugs are provided each having a length so as to provide for failure at an axially applied shear force resulting from a specified over-pressure of the slurry within the pump.

BRIEF DESCRIPTION OF THE SEVERAL VIEWS OF THE DRAWINGS

Preferred embodiments of the invention will hereinafter be described with reference to the accompanying drawings and in those drawings.

DETAILED DESCRIPTION OF THE INVENTION

Figure 1:
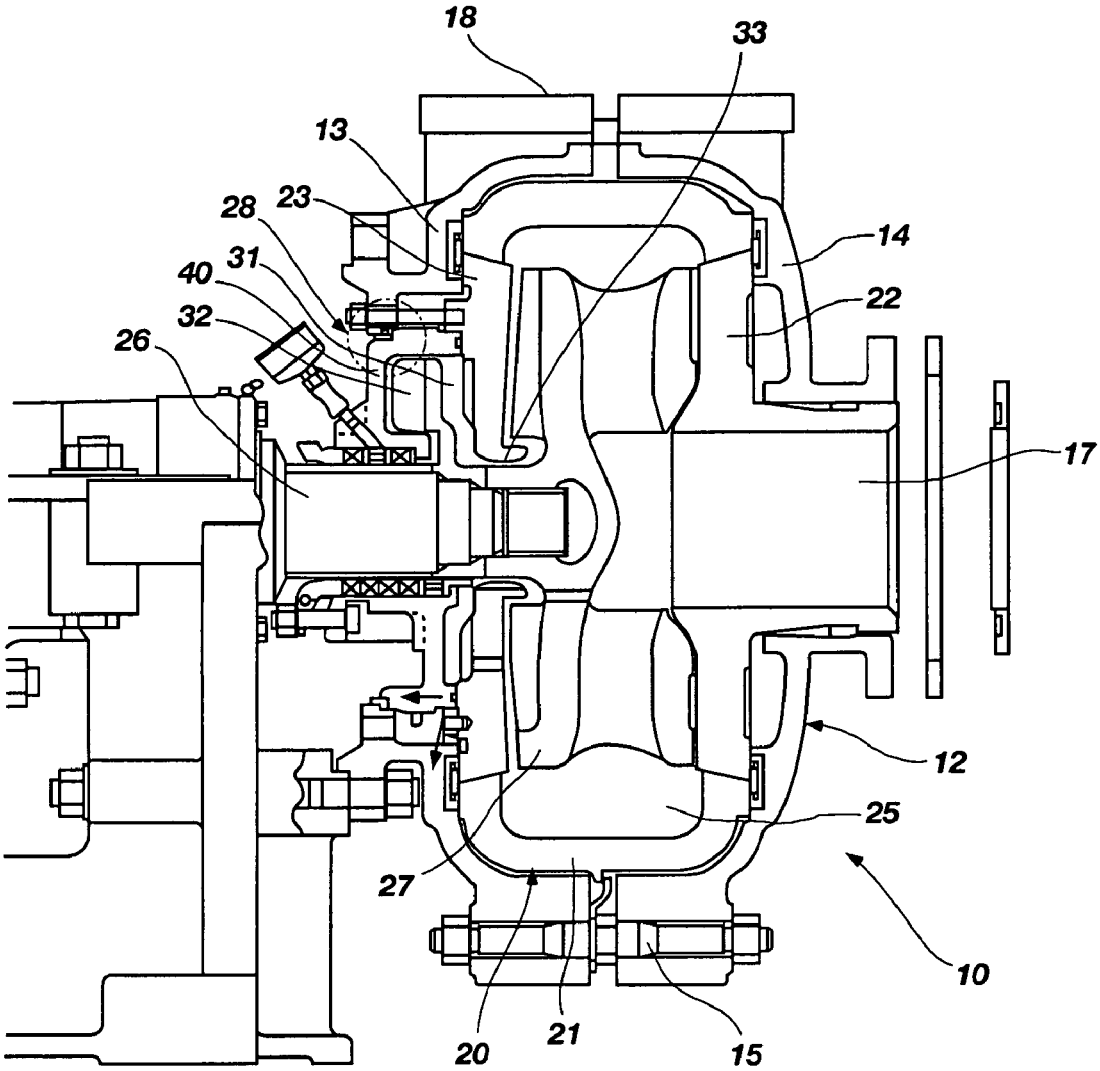
FIG. 1 is a schematic side elevation view in cross section of a pump according to one embodiment of the present invention where the upper portion of the pump illustrated above the centerline depicts a dynamic seal and the lower portion of the pump illustrated below the centerline depicts a gland seal.
Figure 2:
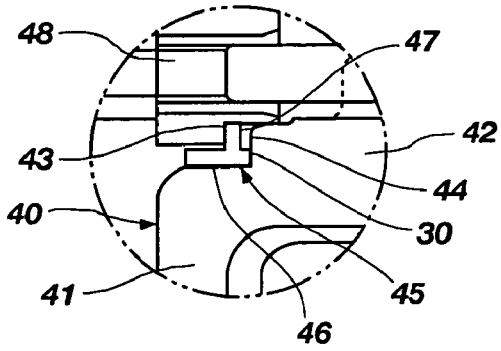
FIG. 2 is a detail from FIG. 1 showing the shearing element of the present invention.
Figure 3:
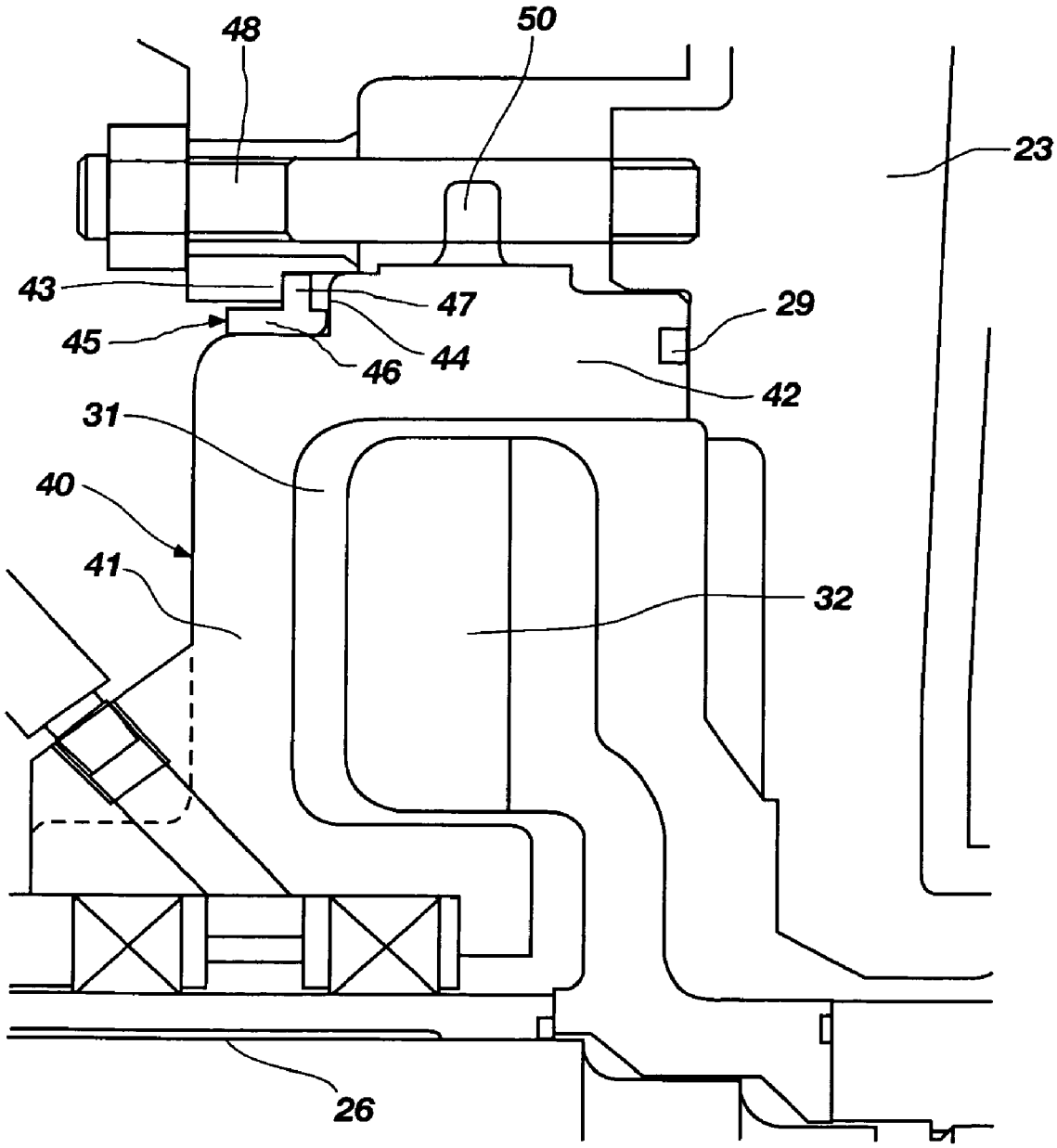
FIG. 3 is an enlarged detail of a part of the seal chamber and pressure relief assembly of the pump of FIG. 1.

Referring to FIGS. 1 to 3 of the drawings, there is shown a pump generally indicated at 10 which includes a housing assembly comprising a pump casing 12 including two parts 13 and 14 connected together by a series of bolts 15. FIG. 1 illustrates part 13 as being a drive side casing and part 14 as a suction side casing that are joined by bolts 15. The pump includes an inlet 17 and an outlet 18. A liner 20 is disposed within the pump casing and includes a peripheral section 21, an inlet section or throatbush 22 and a rear section 23. The pump further includes an impeller 27 disposed within a pumping chamber 25 operatively connected to a drive shaft 26.

The housing assembly further includes a dynamic seal assembly 28 through which the drive shaft 26 extends into the pumping chamber 25. The dynamic seal assembly 28 includes a seal chamber 31 having an expeller 32 therein. The seal chamber 31 is in communication with the pumping chamber 25 via connecting passage 33.

The dynamic seal assembly 28 further includes an outer seal wall 40 which includes a side wall section 41 and a peripheral wall section 42. The outer seal wall 40 is adapted to be mounted in a normal operating position relative to the pump casing 12. To that end, the casing part 13 has a shoulder 43 that cooperates with a shoulder 44 of the outer seal wall 40 for positioning a shearing element 45 therebetween.

Figure 6:
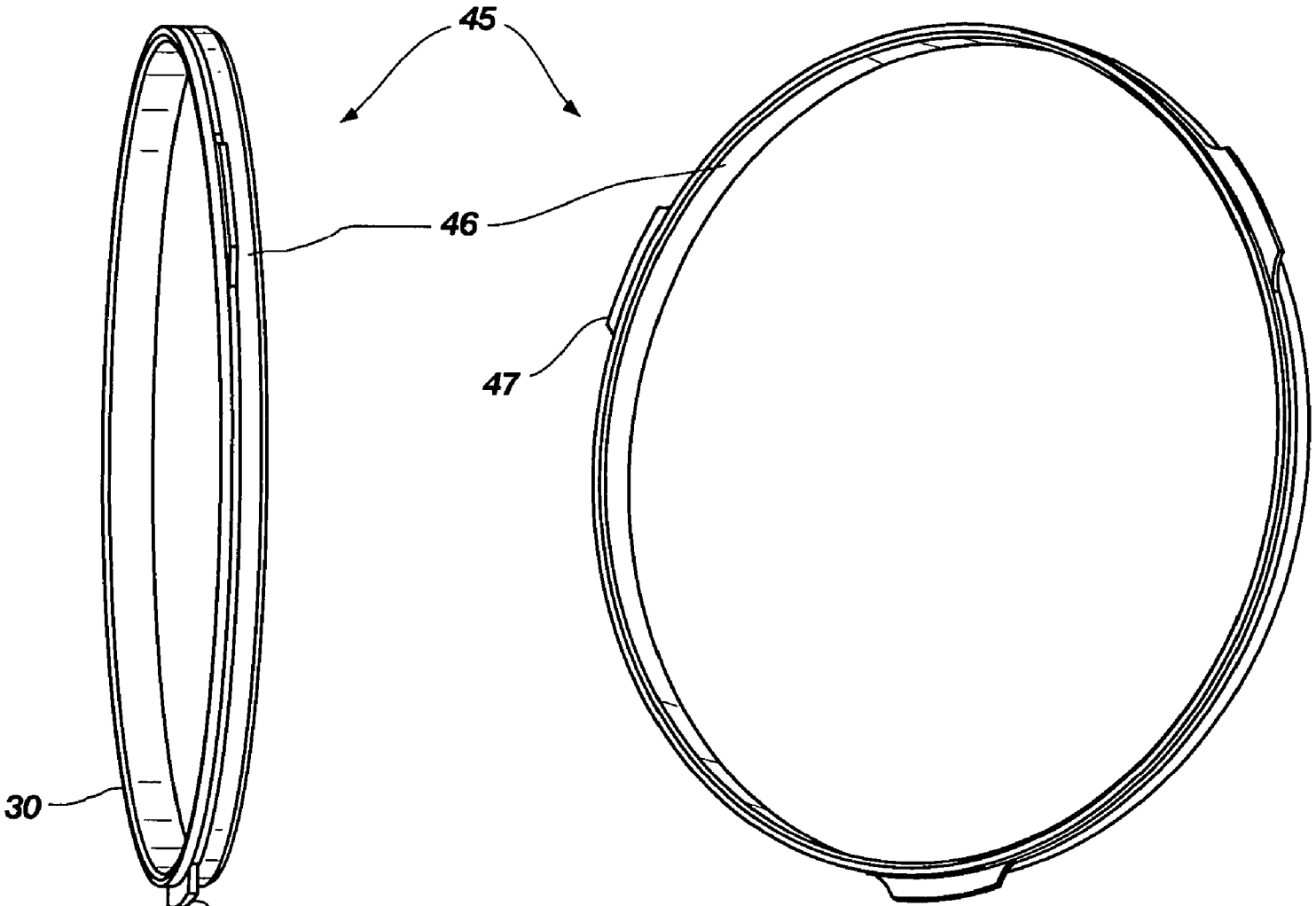
FIGS. 6 and 7 are illustrations of two forms of shearing elements according to the invention.

As shown in FIG. 6 the shearing element 45 includes a ring 46 having one or more shearing members, shown in FIG. 6 as shearing flanges 47 projecting radially from the ring 46. In the normal operating position, one side edge 30 of the ring 46 abuts against shoulder 44 and the shearing flange 47 abuts against shoulder 43. As is apparent from FIG. 2 of the drawings, in the installed position shoulders 43 and 44 are spaced apart. Bolts 48 retain the two parts in the normal operating position. As seen in FIG. 3, the edge of the peripheral wall section 42 includes a sealing element which may be in the form of an O-ring 29 which provides a seal between the outer seal wall 40 and the rear section 23 of the liner.

Figure 7:
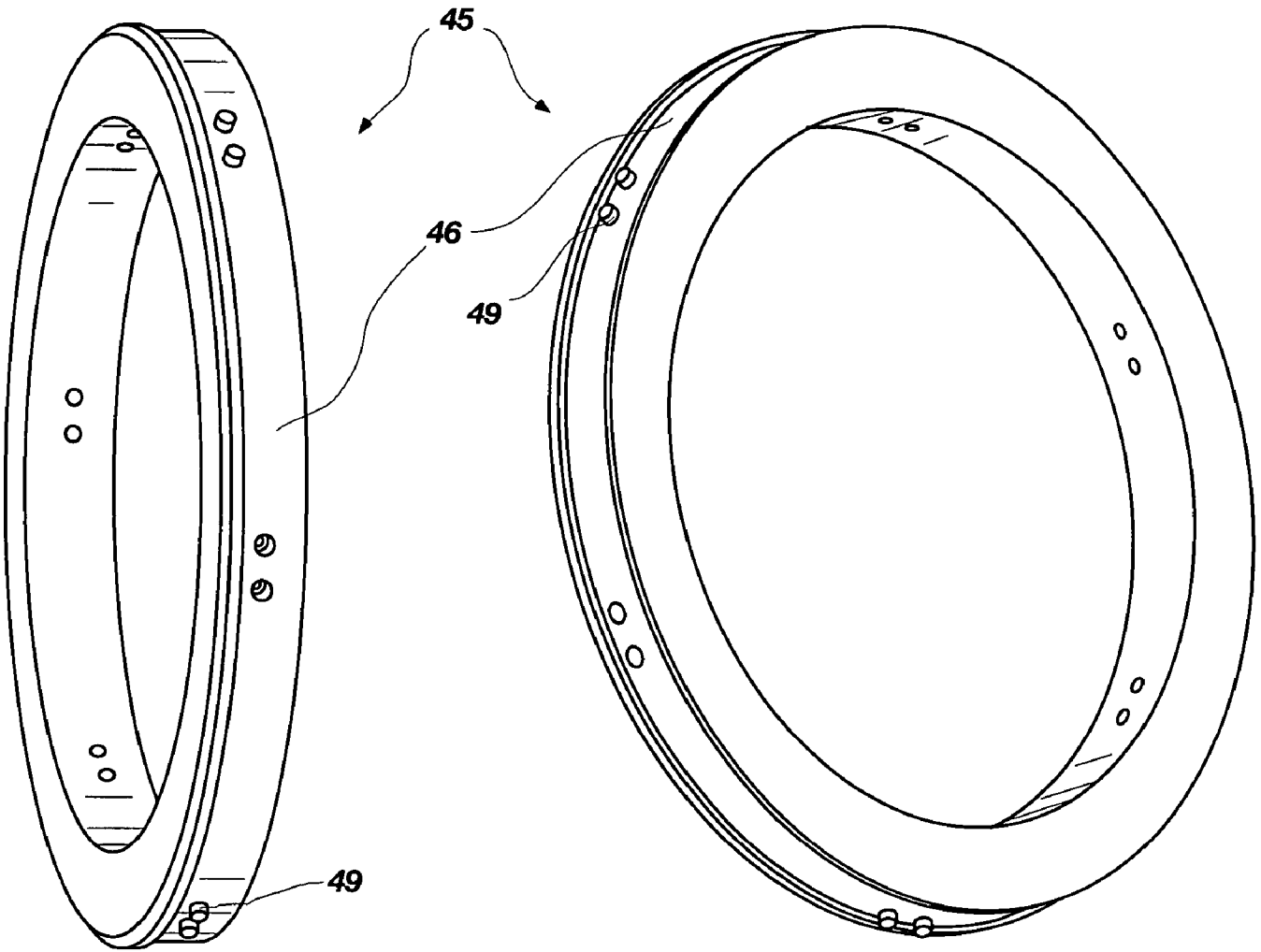

In an alternative embodiment of the shearing element 45, as shown in FIG. 7, the ring 46 may be formed with shearing members in the form of shear pins 49, rather than flanges 47 as shown in FIG. 6. The shear pins 49 of this embodiment extend radially from the ring 46 and are positioned to contact the shoulder 43 of the pump casing 13 as previously described with respect to the embodiment shown in FIG. 6.

It will be appreciated that any pressure within the seal chamber 31 will cause an axial force to be applied to the ring 46 of the shearing element 45. The material of the ring 46 can be metal or nonmetal, provided such material has consistent mechanical strength properties. As described earlier, the shearing element 45 includes a ring 46 with preferably two or more flanges 47 or pins 49 on its outer diameter. The axial force generated by slurry pressure occurring in the pump is transferred into these flanges 47 or pins 49. The flanges 47 and pins 49 are sized so that the area under shear stress is calculated commensurate with the size of the pump and the desired pressure at which failure of the ring 46 will occur. The dimensions of each flange 47 or pin 49 can be varied to vary the area under shear stress and thereby vary the pressure at which failure of the ring 46 of the shearing element 45 will occur.

The shearing element 45 is designed in such a manner that when the pump internal pressure increases to a predetermined value due to, for example, a blockage and zero or near zero flowrate, the flanges 47 or pins 49 will fail, thereby allowing the outer seal wall 40 to move axially outwards and away from the pump casing section 13. This movement unseats or blows out the seal 29 (e.g., o-ring) between the seal chamber 31 and the internal pump liner 23 and allows escape of slurry, thus relieving the internal over-pressure within the pump. The movement of outer seal wall 40 and venting of material is depicted by the arrows in FIG. 1.

The pressure at which the shearing element 45 fails could be set between the pump's maximum allowable operating pressure rating and its maximum allowable test pressure. Specifying a pressure in this range means that the pump components and bolting are not overstressed during the over-pressurization and can be safely re-used following the replacement of the failed shearing element 45.

When the seal (e.g., o-ring 29) between the liner 23 and the outer seal wall 40 leaks, the over-pressurization is relieved inside the pump. As the ring 46 has failed and the seal 29 has been displaced axially, a leak occurs past the O-ring seal 29. The leak will continue since the seal chamber 31 has been permanently moved out of position.

To facilitate the continued relief of pressure, liquid and solids will be forced out past the seal 29 on the seal chamber 31 and then to atmosphere via a series of grooves or flute like passageways on the periphery of the seal chamber 31 or through the radial side walls of casing section 13. Leakage will therefore be continuous between the seal chamber 31 and the pump casing to the outside atmosphere until the pressure inside the pump is close to atmosphere.

Relief of the high pressure and steam will be past the sealing O-ring in the seal chamber 31 since a gap is developed due to the failure of the ring 45 and the seal chamber 31 moving in an axial direction. Alternatively, escape to the outside atmosphere could be via slots or grooves in the seal chamber 31 in addition to, or rather than, by escape via special holes in the drive side portion of the pump casing. Vent pipes could also be attached to the vent holes in the casing or in the seal chamber 31 to direct the escaping liquid and steam downwards to the ground. This would provide added safety.

Leakage and spray from the pump may be contained by a guard or the like over the back or drive side of the pump. In another arrangement, the venting flow may be guarded and directed downwards toward the ground.

The seal chamber 31 may be free to rotate with the shaft 26 if the shearing element 45 fails and the seal chamber 31 is displaced axially and outwards from the pump casing 13. To prevent rotation of the seal chamber 31, one or more stabilizing lugs 50 are cast or fitted to the outside diameter of the seal chamber 31 and the lugs 50 are trapped by a stud bolt or similar device to prevent rotation of the seal chamber 31.

The pressure relief arrangement of the present invention is installed in a pump by positioning the shearing element 45 for retention between the pump casing part 13 (i.e., drive side casing member) and the outer seal wall 40 of the seal chamber 31. The shearing element 45 may be positioned against the pump casing part 13 for subsequent positioning of the seal chamber 31 in place against the pump casing part 13. More typically, the shearing element 45 is positioned about the peripheral wall section 42 of the seal chamber 31 and the seal chamber 31 is then secured in place against the pump casing part 13. The shearing element 45 is positioned so that the flanges 47 or pins 49 are properly positioned against the shoulder 43 of the pump casing part 13. The seal 29 (e.g., o-ring) is then positioned against the edge of the peripheral wall section 42 and the casing liner 23 is positioned in place as per normal assembly of the pump.

Figure 4:
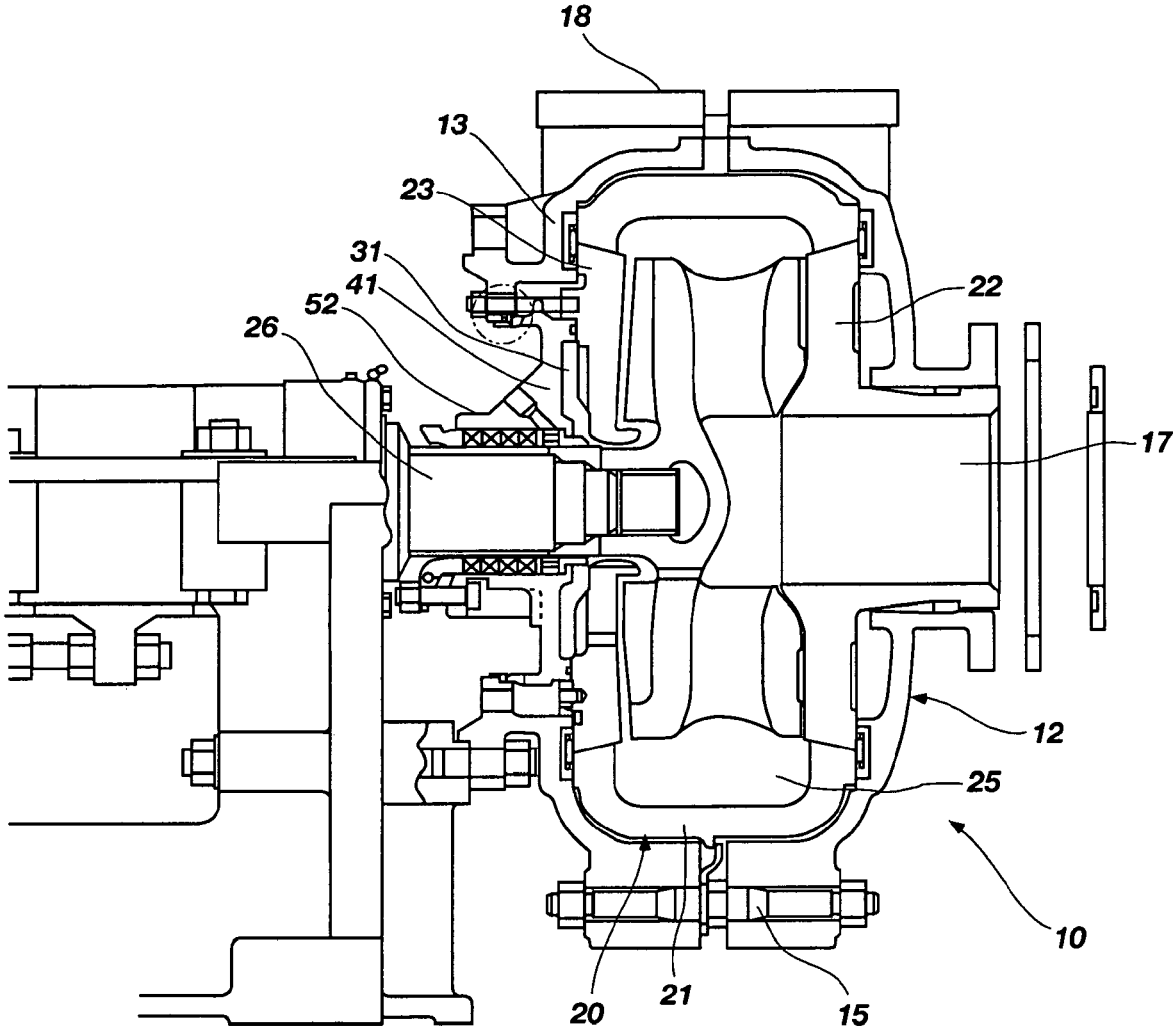
FIG. 4 is a schematic side elevation view in cross section of a pump according to another embodiment of the invention.
Figure 5:
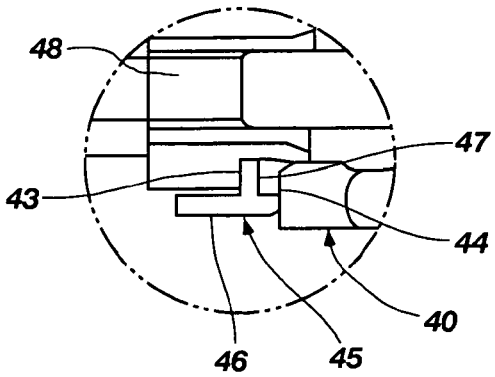
FIG. 5 is a detail from FIG. 4 of a seal ring of the invention.

FIGS. 4 and 5 illustrate a further embodiment of a pump according to the present invention. The same reference numerals have been used to identify the same parts as described with reference to FIGS. 1 to 3. In this embodiment, the dynamic seal assembly 28 of the housing assembly as shown in FIG. 1 is replaced with a gland seal assembly 52. The gland seal assembly 52 includes a gland seal housing or stuffing box 41 mounted for axial movement relative to the pump casing, the shearing element 45 being installed and operable in a similar fashion to that described earlier.

Although a clearance 31 is shown between the liner 23 and the stuffing box 41 in FIG. 4, it is not essential to the working of the invention. All that is required is that pressure within the pumping chamber 25 can act on the gland seal housing or stuffing box 41 to move it axially to a venting position.

The invention provides an arrangement with a continual stand-by pressure relieving capability. The invention may be configured largely independent of pump construction, materials from which the pump components are made, pump components used, the pump installation arrangements, and the associated pipework, and any adjustments that the pump user is likely to make to the pump rendering the invention as an install and forget over-pressure relief protection device. Thus, the pressure relief arrangement of the present invention can be retrofitted into an existing pump.

Advantages of the arrangement include the following: the shearing element fails at a safe pressure and not the pump; i.e. the pump is unaffected; the failure pressure is well within the pump's maximum design pressure; the pump can be re-used by removing and replacing the failed shearing element with a new one; the leakage is contained and controlled. There is no possibility of pieces 'flying' following a failure. The shearing element may be retrofitted when the element fails, none of the other pump parts are put at subsequent risk of failing such as might be the case if the impeller rubbed on the casing due to misalignment immediately following failure.

Finally, it is to be understood that various alterations, modifications and/or additions may be incorporated into the various constructions and arrangements of parts without departing from the spirit or ambit of the invention.

What is claimed is:

1. A pressure relief arrangement for a pump having a drive shaft, a drive side pump casing surrounding the drive shaft and a casing liner, comprising:

a seal chamber configured for positioning about the drive shaft of a pump adjacent the drive side casing of the pump, said seal chamber having a shoulder oriented for positioning in a spaced apart arrangement from a cooperating shoulder of the drive side casing of a pump;

a shearing element having a ring sized for positioning against said shoulder of said seal chamber, said shearing element having at least one shearing member extending radially from said ring and positioned on said ring for contact with the cooperating shoulder of a drive side casing of a pump; and a seal positioned on said seal chamber for contacting the casing liner of a pump to provide a seal between said seal chamber and the casing liner.

2. The pressure relief arrangement of claim 1 wherein said seal chamber is configured to house a mechanical seal for positioning about the drive shaft of a pump.

3. The pressure relief arrangement of claim 1 wherein said seal chamber is configured as a stuffing box for housing gland seals oriented for positioning about the drive shaft of a pump.

4. The pressure relief arrangement of claim 1 wherein said at least one shearing member is a shear flange.

5. The pressure relief arrangement of claim 1 wherein said at least one shearing member is a shear pin.

6. The pressure relief arrangement of claim 1 further comprising at least one stabilizing lug positioned on said seal chamber to extend radially outward therefrom.

7. The pressure relief arrangement of claim 1 wherein said seal chamber is configured with an outer wall section and a peripheral wall section about which said shearing element is positioned to contact said shoulder of said seal chamber.

8. A method for installing a pressure relief arrangement in a rotodynamic pump comprising:

providing a pump having a drive shaft and a pump housing assembly including a pump casing having a drive side casing, a pump liner positioned within the casing, a pumping chamber, an impeller for positioning in the pumping chamber, a pump inlet, and a pump outlet;

providing a seal chamber configured for positioning about the drive shaft of a pump to seal the drive shaft, the seal chamber having a shoulder oriented for positioning adjacent the drive side casing of a pump and having a seal oriented for contacting said pump liner;

providing a shearing element comprising a ring having at least one shearing member extending radially outwardly from said ring;

positioning said shearing element between said drive side casing and said seal chamber to position said shearing element against said shoulder of said seal chamber;

positioning said seal chamber about said drive shaft of said pump casing with said at least one shearing member positioned against a portion of said drive side casing; and positioning said casing liner against said seal of said seal chamber to seal said seal chamber from said pump chamber.

* * * * *